United States Patent [19]

Jetzer et al.

[11] Patent Number: 5,024,589

[45] Date of Patent: Jun. 18, 1991

[54] SPIRAL DISPLACEMENT MACHINE HAVING A LUBRICANT SYSTEM

[75] Inventors: Gregor Jetzer, Nussbaumen; Roland Kolb, Dielsdorf; Fritz Spinnler, Mellingen, all of Switzerland

[73] Assignee: Asea Brown Boveri Ltd., Baden, Switzerland

[21] Appl. No.: 388,822

[22] Filed: Aug. 3, 1989

[30] Foreign Application Priority Data

Aug. 3, 1988 [CH] Switzerland ..... 2939/88
Jun. 8, 1989 [CH] Switzerland ..... 2150/89

[51] Int. Cl.[5] ..... F04C 18/04; F04C 29/02

[52] U.S. Cl. ..... 418/55.3; 418/55.6; 418/94

[58] Field of Search ..... 418/55 B, 55 E, 94

[56] References Cited

U.S. PATENT DOCUMENTS 2,862,655 12/1958 Dickson .

FOREIGN PATENT DOCUMENTS 2603462 3/1982 Fed. Rep. of Germany .
3107231 9/1982 Fed. Rep. of Germany .
3119542 2/1983 Fed. Rep. of Germany .
3141525 5/1983 Fed. Rep. of Germany .
3230979 2/1984 Fed. Rep. of Germany .
3313000 10/1984 Fed. Rep. of Germany .
3534785 4/1986 Fed. Rep. of Germany .
3638470 6/1987 Fed. Rep. of Germany .
16308 10/1912 France .
55-35154 3/1980 Japan ..... 418/55 E

*Primary Examiner*—John J. Vrablik
*Attorney, Agent, or Firm*—Oblon, Spivak, McClelland, Maier & Neustadt

[57] ABSTRACT

A displacement machine for compressing fluids includes a housing, a rotor in the housing and a drive shaft journalled in the housing and eccentrically mounting the rotor. A guide shaft journalled in the housing by a slide bearing guides the oscillation of the rotor. Intermeshing spiral strips on the rotor and housing produce compression of fluid in working chambers during oscillation of the rotor. In order to lubricate the drive and guide shafts, a lubricating system includes a bore supplying lubricant to the slide bearing, lubricant passages in the drive shaft and an intermediate line connecting the lubricant outlets from the slide bearing to the lubricant passages in the drive shaft. The guide shaft may be hollow to provide a bore therein which also communicates with the lubricant outlets from the slide bearing and supplies lubricant to an eccentric of the guide shaft.

11 Claims, 3 Drawing Sheets

SPIRAL DISPLACEMENT MACHINE HAVING A LUBRICANT SYSTEM

BACKGROUND OF THE INVENTION

1. Field of the Invention

The invention relates to a displacement machine for compressible media. More particularly, it relates to for a spiral displacement machine having a lubricant system.

2. Background of the Related Art

Spiral displacement machines forming compressors are known, for example from DE-C- 26 03 462. Such compressors provide an almost pulsation-free delivery of, for example, a gaseous working fluid consisting of air or an air-fuel mixture and therefore could advantageously be used, i.a., for supercharging internal combustion engines. During the operation of such a compressor several approximately crescent-shaped working spaces are enclosed along the displacement chamber between the spiral-shaped displacement body and the two peripheral walls of the displacement chamber. The working spaces move from the intake through the displacement chamber to an output, while their volume is continuously reduced and the pressure of the working fluid is consequently increased.

A machine of this type is also known from DE-A-3 313 000. Because two eccentric arrangements, spaced from one another, are provided, one of which can be driven by a drive shaft, a statically determined bearing results, which guarantees a forcible oscillatory guiding of the rotor except at the top and bottom dead centers of oscillation. To achieve a precise guiding at the dead center positions of the rotor, a guide shaft of the second eccentric arrangement, supported in the housing, is positively connected to the drive shaft by e.g., a synchronous belt drive. Several means are known for flexibly accommodating any optional differences in spacing between the delivery chamber and the displacement body.

A precise movement of a displacement body according to the spiral principle is achieved by a translatory circular motion, i.e., oscillation, by double crank drive, as is known, for example, from DE-A-3 230 979 and in which one crank drives and the second crank guides. To be able to equalize the differences in length between the two points of application of the drive arrangement and guide arrangement, this known solution provides a transfer element that is longitudinally slidable, namely, in the direction of the connecting line of the points of application. This transfer element consists of a holding element adjustably held in the guide arrangement of the rotor. The holding element can be a slide ring which can slide in a parallel guide. The parallel guide comprises one of the two bearings of the guide arrangement, by which thus an optional equalizing of the expansion differences can take place.

Another solution for this problem is described in DE-A-3 107 231. To avoid inadmissibly high stresses, which can occur by buildup of tolerances during production or by different heat expansions between the two points of application on the rotating rotor, a bearing arrangement with an elastic bed is provided on at least one of the points of application, preferably on the point of application of the guide device. This elastic bed can be formed, for example, by a rubber ring, which sits between the bearing outside race and the bearing eye.

In all known spiral compressors, in which for translatory guiding of the rotor a guide shaft running at a synchronous angle with the drive shaft is provided, the bearing of the two shafts takes place by roller bearings. This can be especially clearly seen in the displacement machine according to DE-A-3 141 525 in which the drive shaft is mounted in the housing in two ball bearings and an eccentric collar is placed on the drive shaft by a roller bearing, while the guide shaft is mounted in the housing by two ball bearings and the eccentric pin of the guide shaft in the rotor disk by a needle bearing. In this case, the needle bearing in the rotor disk is generally lubricated with grease (DE-A-3 638 470), while the highly stressed eccentric bearing of the drive shaft is lubricated with oil (DE-A-3 320 086).

It is known from DE-C-3 119 542, in an arrangement for the bearing of an eccentric drivable rotor, to design the bearings for a disk rotatably mounted in a stationary housing and for the driver connected with it, as slide bearings. But the basic idea of this design, in the use of the spiral machine in the engine drive, is that if the rotor is exposed to very hot gases, the complete bearing of the eccentric device is shifted onto the stationary housing where a sealing from aggressive hot gases as well as sufficient cooling are possible. In this known arrangement only the drive eccentric arrangement, but not the guide eccentric arrangement, is provided with the slide bearing.

SUMMARY OF THE INVENTION

Starting from the knowledge that, as a result of the high thermal and mechanical stresses inherent in a slide bearing, the main eccentric bearing cannot get by without continuous lubrication with a liquid lubricant, an object of the invention is to simplify the bearing of the displacement machine in order to optimize cost.

This and other objects are attained in that the guide shaft in the housing is mounted via a sliding bearing and the lubricant outlet of the slide bearing communicates via an intermediate line with the lubricant feed means for the drive shaft.

Aside from reducing the cost of the machine, as a result of the replacement of two roller bearings by one slide bearing, and reduced radial dimensions resulting in a reduction in overall dimensions, a special advantage is derived from the possibility of a greater radial play in comparison with the radial play of roller bearings, resulting in the ability to flexibly absorb optional differences in spacing between the guide shaft and the drive shaft.

It is especially favorable if the guide shaft is hollow and communicates with the lubricant outlet of the friction bearing by a wall passage or bore, and if the hollow inside space of the guide shaft is connected, by a longitudinal bore in the eccentric pin of the guide shaft, to the lubricant space of the guide bearing for the guide shaft. As a result there is the possibility of also getting by without the conventional roller bearing, and instead also providing a cost-favorable slide bearing at this location.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 2:
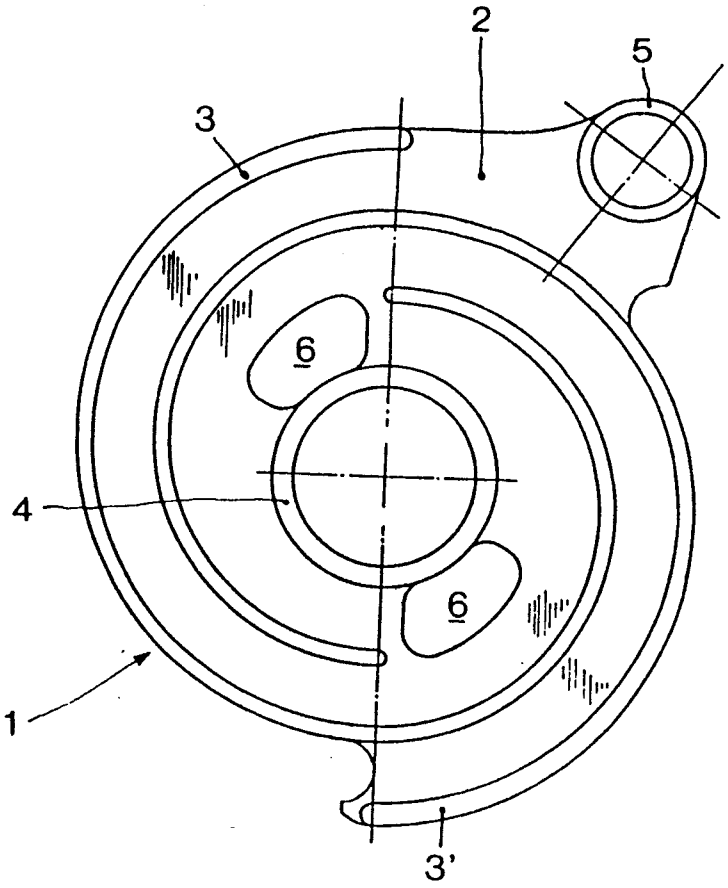
FIG. 2 is a front view of a rotor of the displacement machine.
Figure 1:
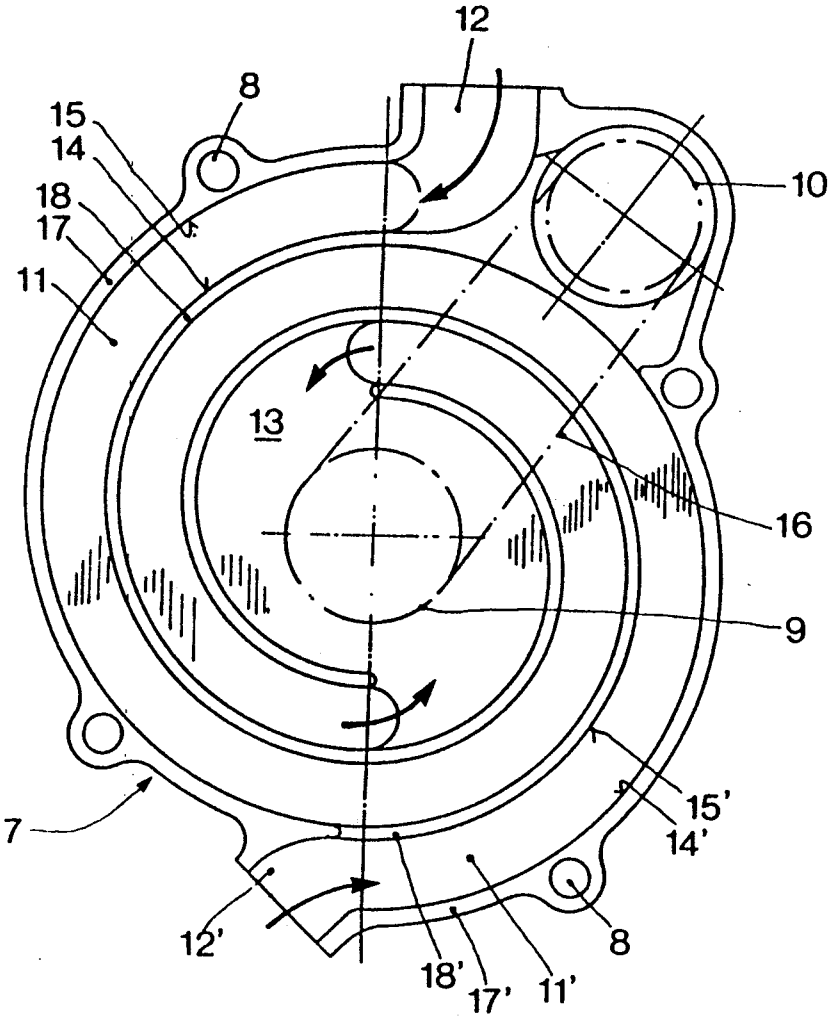
FIG. 1 is a front view of a housing half of the displacement machine.

For clarity's sake, the machine in FIG. 1 and 2 is shown in the dismantled state.

Figure 3:
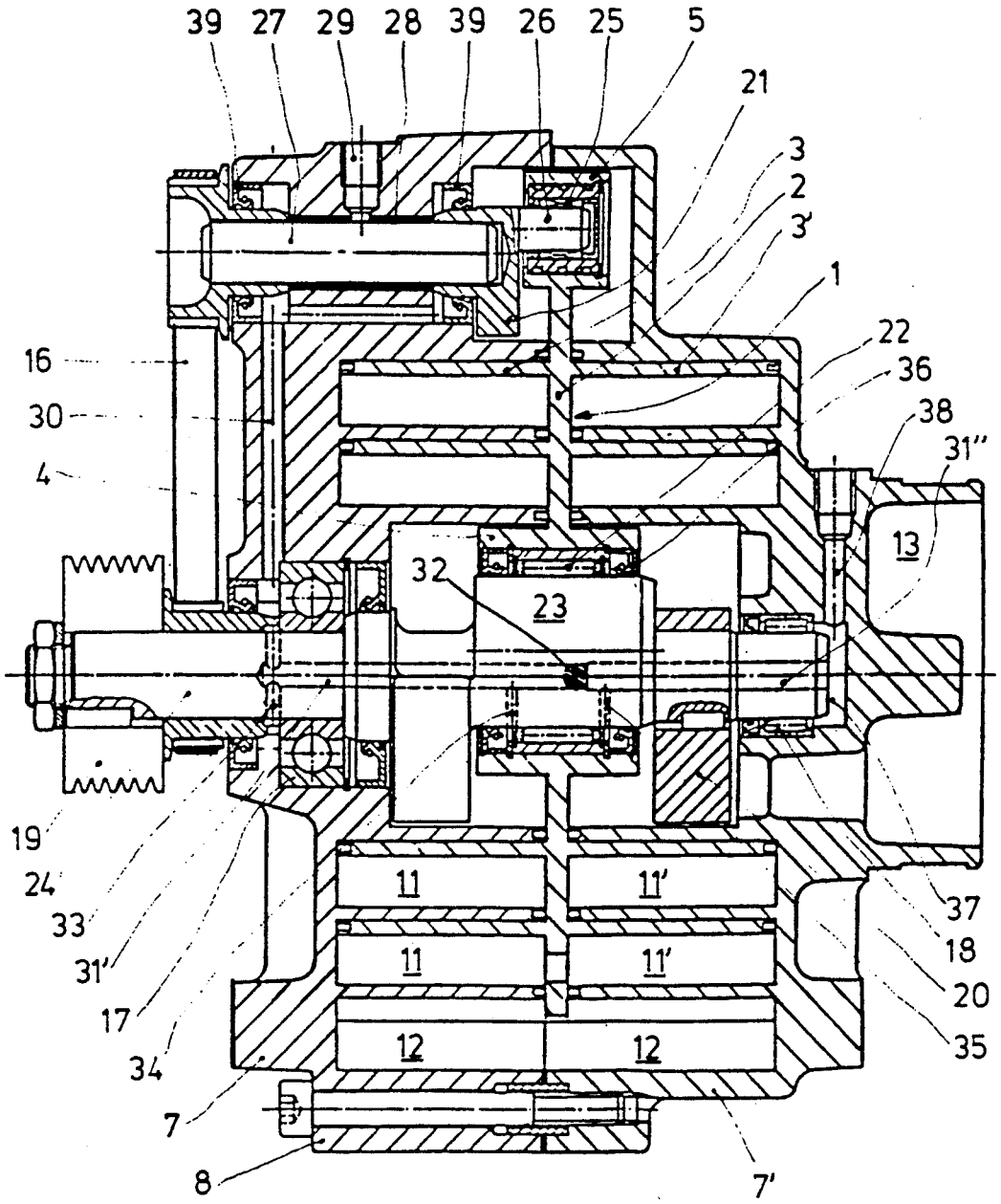
FIG. 3 is an axial section through the displacement machine.

Referring to FIGS. 1 through 3, the rotor 1 of the machine has a planar disk 2. Two spiral displacement bodies are placed on each of the two sides of disk 2, and are offset by 180° from one another.

The displacement bodies are spiral strips 3, 3' which extend perpendicular to the plane of disk 2. The spiral strips themselves, in the example shown, may be formed from several arcs connected to one another.

Disk 2 rotates on a roller bearing 22 via a hub 4 of the disk. The bearing 22 itself is seated on a first eccentric disk 23 which is part of a drive shaft 24.

The disk 2 includes an eye 5 positioned radially outside strips 3, 3', within which fits a guide bearing 25 attached to an eccentric pin 26 of a second eccentric. Pin 26 forms an end part of a guide shaft 27.

Two passages 6 are provided in the disk at positions corresponding to the inner ends of the spiral strips so that the compressed medium can go from one side of the disk 2 to the other. This is advantageous in that it permits the gas to be discharged from a central outlet placed only on one side of the disk.

The rotor 1 is positioned in a machine housing formed as two housing halves 7 and 7'. Housing half 7 of the machine housing is connected to housing half 7' by screws fitted in mounting eyes 8. Reference number 9 symbolizes generally the mounting for the drive shaft, while reference number 10 symbolizes generally the mounting for the guide shaft. Two delivery chambers 11 and 11', respectively offset by 180° from one another, are formed as spiral slots in each of the two housing halves. They each run from an intake 12, 12' at the outside periphery of the spiral 11, 11' to an outlet 13, common to two delivery chambers and provided in the housing interior. The spiral alots forming the delivery chambers are defined between substantially parallel spiral walls 14, 14', 15, 15', extending from the housing wall and spaced at constant distances from one another. They together comprise a spiral of about 360° just like the displacement bodies of disk 2. Between these spiral walls fit the spiral strips 3, 3, whose curvature is dimensioned so that the strips 3, 3' almost touch the spiral walls 14, 14', 15, 15' of the housing at several, for example two, points in each housing half.

The first and second spaced eccentric arrangements 23, 24 or 26, 27 provide the drive and guiding of rotor 1. Drive shaft 24 is mounted in roller bearings 17 and 18. Its end projecting from housing half 7 is provided with a V-belt pulley 19 for the drive. Counterweights 20 are placed on drive shaft 24 for balancing the mass of the eccentric 23. Such a balancing weight 21 is also attached to guide shaft 27 for balancing eccentric pin 26. This guide shaft 24, which is sealed on both sides with ring seals 39, is fitted in a sliding bearing 28 in housing half 7. The slide bearing 28 may be lined with low friction material. It is sized so as to leave an annular space permitting a flow of liquid lubricant between the guide shaft and the bearing surface, as is further described below.

To achieve a precise guiding of the rotor 1 at the dead center positions, the two eccentric arrangements 23, 24 or 26, 27 are precisely synchronized by a synchronous drive belt 16. This double eccentric drive assures that all points of the rotor disk, and thus also all the points of the two spiral strips 3 and 3', perform a circular sliding (i.e., oscillatory) movement. As a result of the multiple variable approaches of spiral strips 3, 3' to the inside and outside walls of their respective delivery chambers there are produced on both sides of the strips crescent-shaped working spaces enclosing the working fluid, which during driving of the rotor disk are displaced through the delivery chambers in the direction of the outlet. In this case, the volumes of these working spaces are progressively decreased and the pressure of the working fluid is correspondingly increased.

A more detailed description of the structure and the general mode of operation of such compressors, which is operation is not the object of the invention, is made in DE-C3-2 603 462, already mentioned.

A common system is provided for lubricating the bearings placed in housing 7, 7' as well as first eccentric bearing 22. The lubricant, preferably oil, is fed by a bore 29 in housing half 7 to sliding bearing 28 from a lubricant source (not shown). The oil flows in the annular space between the guide shaft and bearing surface to lubricate the bearing and is collected on both sides of this bearing 28. From there, the oil is fed by an intermediate line or bore 30 into the area of drive shaft 24. There a part of the oil is used for lubricating roller bearing 17. The radial play provided by the annular space in the slide bearing accommodates slight differences in spacing between the drift shaft and the guide shaft.

In drive shaft 24 there are provided drive shaft lubricating means including first and second longitudinal bores 31', 31", which for production reasons are machined together and later are divided by a plug 32 placed in the plane of roller bearing 22. Lubricating oil is fed into longitudinal bore 31' by radial bores 33, which communicate with bore 30 in the housing. Radially directed cross bores 34 and 35 branch off from longitudinal bores 31', 31" in the area of eccentric disk 23. The cross bores lead to opposite ends of roller bearing 22 which are laterally sealed by ring seals 36. As a result, lubricant passes through roller bearing 22 in order to reach bore 31" from bore 31'. On the free end of drive shaft 24 longitudinal bore 31" ends in a chamber 37, from which roller bearing 18 is lubricated. The lubricant is removed from housing half 7' via chamber 37 and a lubricant discharge line including bore 38.

Figure 4:
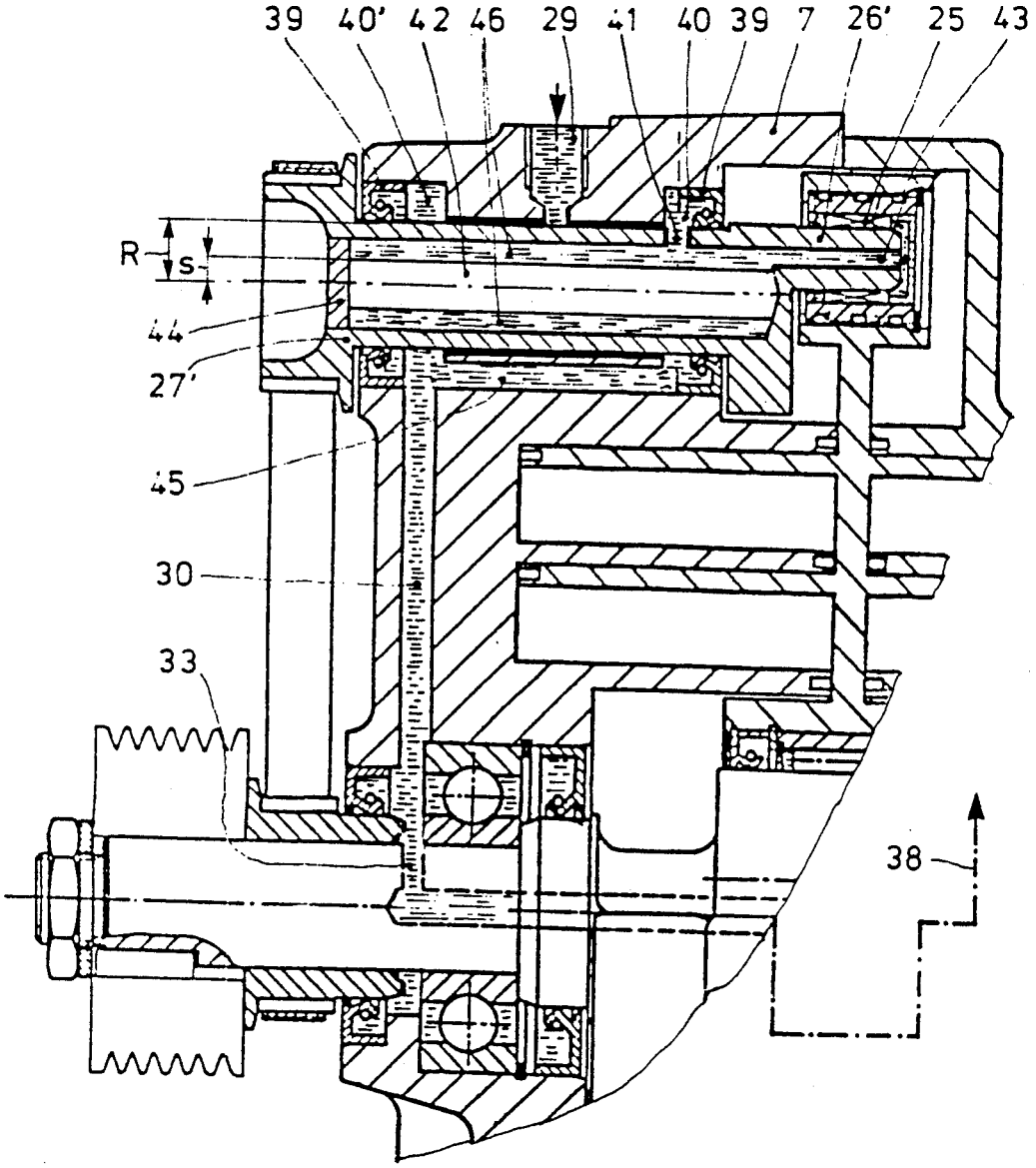
FIG. 4 is a partial longitudinal section through a variant embodiment having a modified guide shaft.

FIG. 4 shows another embodiment of guide shaft 27' during operation, i.e., with circulating lubricant. This embodiment makes it possible to use the lubricant for also lubricating guide bearing 25. For this purpose, shaft 27' is made with a bore so as to be hollow. The drive side end of hollow interior space 42 is provided with a cover 44. The wall shaft 27' is pierced with a wall bore 41 which is placed in the communication with lubricant outlet 40 of the slide bearing. Of course, this wall bore could also be in communication with drive side lubricant outlet 40'. Lubricant outlets 40, 40' provided on both sides of the slide bearing are connected to one another by bore 45. As an extension of the hollow interior space 42, eccentric pin 26' exhibits a longitudinal bore 43 which penetrates the pin over its entire length and ends in a closed lubricating space of guide bearing 25.

During operation, a lubricant ring 46 forms in the hollow interior space. This ring provides guide bearing 25 (which thus also may be a slide bearing) with lubricant via bore 43. For this feature to function, it is essential that a permanent connection be maintained from lubricant outlets 40, 40', by a line 30, to radial bore 33 on drive shaft 24. As a result of the action of centrifugal force in radial bore 33 on the above lubricant column, an excess pressure is produced in the communicating line 30. This pressure is so great that the lubricant from bore 29 and lubricant outlet is forced through wall bore 41 into hollow interior space 42 to form the lubricant ring 46. This ring 46 has a size (R-s), in which R is the outside radius of guide shaft 27' and s is the distance from the shaft axis to the inside wall of the lubricant ring. The excess pressure in the communicating lubricant line 30 is a function of the rotational speed of the shaft 24. On the other hand, the thickness of the lubricant ring 46 is generally a function of the length of bore 33 and the outside radius R of the guide shaft. Radius R should be small enough that the pressure from line 30 is sufficient to overcome the pressure in the ring 46 at normal operating speeds.

Without the counterpressure in system 30, 45, 40, 40', caused by centrifugal force produced in radial bore 33, the lubricant would be pressureless at the outlet from friction bearing 28 and would simply flow out into pipe 30, without getting into the inside of hollow space 42 by wall bore 41. On the other hand, during the operation the counterpressure in system 30, 45, 40, 40' has to be high enough to avoid the lubricant being flung out of bore 41 into space 40. But, further, the counterpressure in system 30, 45, 40, 40' must not be so great that the lubricant is conveyed back through friction bearing 28 into the intake bore 29. This means that the intake pressure of the lubricant in bore 29 in any case has to be higher than the pressure in system 30, 45, 40, 40' caused by centrifugal force. Thus, the remaining lubricant pressure on the radially innermost plate of radial bore 33, i.e., in longitudinal axis 31' is large enough to guarantee the lubrication of drive shaft 24.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. A displacement machine for compressing fluids, comprising:

a housing;

a rotor in said housing;

a drive shaft journalled in said housing and having first eccentric means for oscillating said rotor about the drive shaft axis;

a guide shaft rotatably coupled to said drive shaft and journalled in said housing by a slide bearing, said guide shaft having second eccentric means for guiding the oscillation of said rotor;

spiral means on said housing and said rotor for compressing a fluid during oscillation of said rotor; and a lubricating system comprising:

a) means for supplying lubricant to said slide bearing, b) drive shaft lubricating means, and c) an intermediate line connecting lubricant outlets from said slide bearing to said drive shaft lubricating means, whereby radial play in said slide bearing accommodates variations in a spacing between said drive shaft and said guide shaft.

2. The displacement machine of claim 1 wherein said drive shaft lubricating means comprises:

a first longitudinal bore in said drive shaft and communicating with said intermediate line;

a first cross bore connected between said first longitudinal bore and an end of a bearing for said first eccentric means;

a second longitudinal bore in said drive shaft and communicating with a lubricant discharge line; and a second cross bore connected between said second longitudinal bore and another end of the bearing for said first eccentric means, whereby lubricant from said first longitudinal bore passes through the bearing for said first eccentric means before reaching said second longitudinal bore.

3. The displacement machine of claim 2 including means between said second longitudinal bore and the lubricant discharge line for supplying lubricant to a bearing for said drive shaft.

4. The displacement machine of claim 1 including means for lubricating said second eccentric means.

5. The displacement machine of claim 4 wherein said second eccentric means comprises an eccentric portion of said guide shaft rotatably engaging said rotor and a bearing between said eccentric portion of said drive shaft and said rotor, wherein said means for lubricating said second eccentric means comprises:

a bore in said guide shaft extending into said eccentric portion and communicating with said bearing between said eccentric portion and said rotor;

wall passages in said guide shaft communicating said bore in said guide shaft with one of the lubricant outlets from said slide bearing, whereby lubricant from said slide bearing can reach said bearing between said eccentric portion and said rotor via said bore in said guide shaft.

6. The displacement machine of claim 5 wherein said guide shaft has an outer radius sufficiently small that the fluid pressure of lubricant therein is less than the fluid pressure of lubricant in the one lubricant outlet from said slide bearing.

7. The displacement machine of claim 3 including means for lubricating said second eccentric means.

8. The displacement machine of claim 7 wherein said second eccentric means comprises an eccentric portion of said guide shaft rotatably engaging said rotor and a bearing between said eccentric portion of said drive shaft and said rotor, wherein said means for lubricating said second eccentric means comprises:

a bore in said guide shaft extending into said eccentric portion and communicating with said bearing between said eccentric portion and said rotor;

wall passages in said guide shaft communicating said bore in said guide shaft with one of the lubricant outlets from said slide bearing, whereby lubricant from said slide bearing can reach said bearing between said eccentric portion and said rotor via said bore in said guide shaft.

9. The displacement machine of claim 8 wherein said guide shaft has an outer radius sufficiently small that the fluid pressure of lubricant therein is less than the fluid pressure of lubricant in the one lubricant outlet from said slide bearing.

10. The displacement machine of claim 5 wherein said bearing between said eccentric portion of said guide shaft and said rotor comprises a slide bearing.

11. The displacement machine of claim 9 wherein said bearing between said eccentric portion of said guide shaft and said rotor comprises a slide bearing.

* * * * *